US005832824A

United States Patent [19]

Okubo et al.

[11] Patent Number: 5,832,824

[45] Date of Patent: Nov. 10, 1998

[54] PRINTING BLANKET

[75] Inventors: Hiromasa Okubo, Kobe; Toshikazu Kinoshita, Itami, both of Japan

[73] Assignee: Sumitomo Rubber Industries, Ltd., Kobe, Japan

[21] Appl. No.: 915,084

[22] Filed: Aug. 20, 1997

Related U.S. Application Data

[63] Continuation-in-part of Ser. No. 600,604, Feb. 13, 1996, abandoned.

[51] Int. Cl.[6] ..... B41F 7/02

[52] U.S. Cl. ..... 101/217; 428/904

[58] Field of Search ..... 101/217, 75; 428/909

[56] References Cited

U.S. PATENT DOCUMENTS 5,066,537 11/1991 O'Rell et al. ..... 428/246
5,347,927 9/1994 Berna et al. ..... 101/401.1
5,440,981 8/1995 Vrotacoe et al. ..... 101/217
5,478,637 12/1995 Tomono et al. ..... 428/246

*Primary Examiner*—Edgar S. Burr
*Assistant Examiner*—Dave A. Ghatt
*Attorney, Agent, or Firm*—Nikaido, Marmelstein, Murray & Oram LLP

[57] ABSTRACT

There is provided a printing blanket having no seam in the circumferential direction thereof, which realizes high quality of printings in a wide range from normal printing to high, speed printing, and which has high strength to facilitate the handling and prolonged life, thus enabling the reuse of the sleeve and the like.

Specifically, on the peripheral surface of the cylindrical sleeve 21, the base layer 1, the compressible layer 2, the non-stretchable layer 3 and the surface printing layer 4 are laminated by interposing the adhesive layers 31, 32, 33 and 34, respectively. All of the above layers comprise a seamless elastomer. The non-stretchable layer 3 is prepared by winding a wire rod in helical fashion.

5 Claims, 1 Drawing Sheet

PRINTING BLANKET

CROSS REFERENCE TO RELATED APPLICATION

This is a continuation-in-part application of U.S. patent application Ser. No. 08/600,604, filed on Feb. 13, 1996, now abandoned.

BACKGROUND OF THE INVENTION

1. Field of the Invention

This invention relates to a seamless printing blanket which is particularly suitable to use in high-speed offset rotary printers.

2. Description of the Prior Art

A conventional printing blanket is in the form of flat plate, and has been used by winding it around a blanket cylinder of a printer.

The printing blanket has a seam portion on the surface thereof. Hence, whenever the seam of the printing blanket passes a nip deformed portion which is generated by pressing the printing blanket with a plate cylinder and the like, the pressing pressure is varied to cause vibration and impact load, so that the quality of printing deteriorates.

To solve the above problem, Japanese Unexamined Patent Publication No. 5-301483 (1993) discloses a printing blanket wherein (i) a porous and seamless compressible layer comprising elastomer such as rubber, (ii) a non-stretchable layer and (iii) a seamless surface printing layer are laminated in this order by interposing a seamless adhesive layer between the respective layers, on an outer peripheral surface of a cylindrical sleeve mounted on a blanket cylinder.

The compressible layer, the surface printing layer and the adhesive layer are formed by applying and drying a coating solution including elastomer, and if used rubber, followed by vulcanization. The compressible layer is formed in a porous state in order to render vibration absorbability and pressure absorbability to the printing blanket. The non-stretchable layer is formed by winding a non-stretchable wire rod, such as thread, in helical fashion in the circumferential direction.

The inside diameter of the sleeve corresponds to the outside diameter of the blanket cylinder, or is slightly smaller than that outside diameter, so that the sleeve is strongly engaged with the blanket cylinder in the normal condition, and when an internal pressure is applied, the sleeve has a slight expansion in the radial direction, which permits removal of the blanket cylinder. Thus in order to apply the internal pressure, aeration holes, through which a pressurized gas can be supplied inside the sleeve, are formed in the blanket cylinder.

Suitable sleeves include those made of pretty thin metallic material and those made of fiber-glass reinforced plastics. The most preferred are those made of nickel having a thickness of about 0.125 mm in view of the rigidity, the strength and the elasticity.

Since the above printing blanket does not have any seams in the circumferential direction thereof, it causes neither vibration nor impact load at the time of printing. However, a plate cylinder, onto which the printing blanket is pressed, has a seam and, when this seam passes the nip deformed portion, vibration and impact are generated.

Some of the vibration and the impact can be absorbed by the compressible layer and the surface printing layer comprising elastomer as described, particularly the compressible layer which is porous and has vibration absorbability.

Therefore, they might not cause any serious problems for normal printing. However, when high-speed printing of not less than 1,000 r.p.m. is carried out by a high-speed offset rotary printer or the like, the vibration and the impact are large, which cannot satisfactorily be absorbed merely by the compressible layer and the surface printing layer.

On the other hand, in the printing blanket, irrespective of the seam of the plate cylinder, a large expansion in the radial direction, caused by the elastic rebound of the printing blanket which is released from the compression after passing the nip deformed portion, and the ordinary waves wherein the surface printing layer waves due to the expansion, can be prevented by the non-stretchable layer comprising non-stretchable wire rod. At the time of the high speed printing as described, however, the ordinary waves caused by high-speed repeated compression which is generated when passing the nip deformed portions, expand to the compressible layer and the non-stretchable layer over the surface printing layer, and therefore, it is impossible to prevent these phenomena only by the non-stretchable layer.

Accordingly, the above printing blanket has the disadvantage that printing images particularly at high-speed printing are unclear, thereby resulting in poor printing quality. Further at high speed printing, dynamic fatigue and heat are generated in the respective layers due to the high-speed repeated compression as described, so that the printing blanket life is short. In particular, the porous compressible layer, which has lower strength than other layers, is liable to cause permanent set due to the dynamic fatigue and the heat, and then lose the elasticity, that is, a so-called "permanent set in fatigue".

In order to obtain high printing quality, the individual layer including the compressible layer, the non-stretchable layer, the surface printing layer and the adhesive layer are preferably as thin as possible. However, when each layer is made thinner, the strength of the printing blanket in the thickness direction is decreased. For example, when an external impact is applied, the impact travels to the sleeve made of pretty thin metallic material as described, which is liable to have concavities or damage. This requires delicate treatment in the transportation and the like, so that the working ability deteriorates and the wrapping and the transportation cost rises.

Moreover, when the above printing blanket has been use for a long period, particularly the compressible layer causes the permanent set in fatigue as previously described. Thus, from the viewpoint of effective utilization of resources and environmental protection, it Is desirable that at least the sleeve be recovered for its reuse.

In the conventional printing blanket, however, when the compressible layer, which is formed immediately on the sleeve through an adhesive layer, is peeled by grinding, the sleeve made of pretty thin metallic material is liable to be damaged, which might often cause the damage of the sleeve, preventing reused.

SUMMARY OF THE INVENTION

It is a main object of this invention to provide a seamless printing blanket which realizes high quality printing over a wide range from normal printing to high-speed printing, and which has high strength to facilitate its handling.

Another object of this invention is to provide a printing blanket which has longer life and facilitates the reuse of a sleeve and the like.

The printing blanket of this invention comprises:

a) a seamless base layer comprising an elastomer and being substantially incompressible;

b) a porous seamless compressible layer comprising an elastomer;

(c) a non-stretchable layer comprising a non-stretchable thread which is wound on the compressible layer in helical fashion along the circumferential direction; and (d) a seamless surface printing layer comprising an elastomer, all of which are provided in this order on an outer peripheral surface of a cylindrical sleeve mounted on a blanket cylinder.

Seamless adhesive layers comprising elastomer are interposed between each pair of respective layers.

The base layer which is substantially incompressible is non-porous layer. The term "incompressible" means that the layer is elastically deformable, but not volume compressible.

The base layer is formed immediately on the sleeve, and functions to absorb vibration and impact load whenever a seam of the plate cylinder passes a nip deformed portion.

The base layer also functions, together with the non-stretchable layer, to prevent the elastic rebound caused by the printing blanket when it is released from compression after passing the nip deformed portion, from generating a large expansion in the radial direction and the resulting ordinary waves.

The base layer and other layers in this printing blanket do not have any seam in the circumferential direction. It is therefore possible to obtain high quality printings over a wide range from normal printing to high-speed printing.

The base layer and the non-stretchable layer function to prevent a large expansion in the radial direction due to the elastic rebound of the printing blanket, so that high-speed repeated compression at high speed printing can be depressed. Therefore, dynamic fatigue and heat can be depressed, thus enabling to prolong the printing blanket life.

The base layer also functions to reinforce and protect the sleeve. This allows the printing blanket to have higher strength then conventional ones, to facilitate its handling.

Moreover, the compressible layer, which has lower strength than other layers and is most frangible after the prolonged use of the printing blanket, is formed on the base layer, not immediately on the sleeve. This facilitates the removal of the compressible layer, without causing damage to the sleeve. In addition, since the base layer is not so fragile as the compressible layer, it is possible to reuse the sleeve with the base layer remaining attached to the sleeve.

When preparing the printing blankets wherein the outside diameters are slightly different, the base layer can function to adjust the thickness of the printing blanket, thereby permitting the use of a common mandrel in producing the printing blankets to offer favorable productivity.

DETAILED DESCRIPTION OF THE INVENTION

This invention will be further described referring the Drawings.

Figure 1:
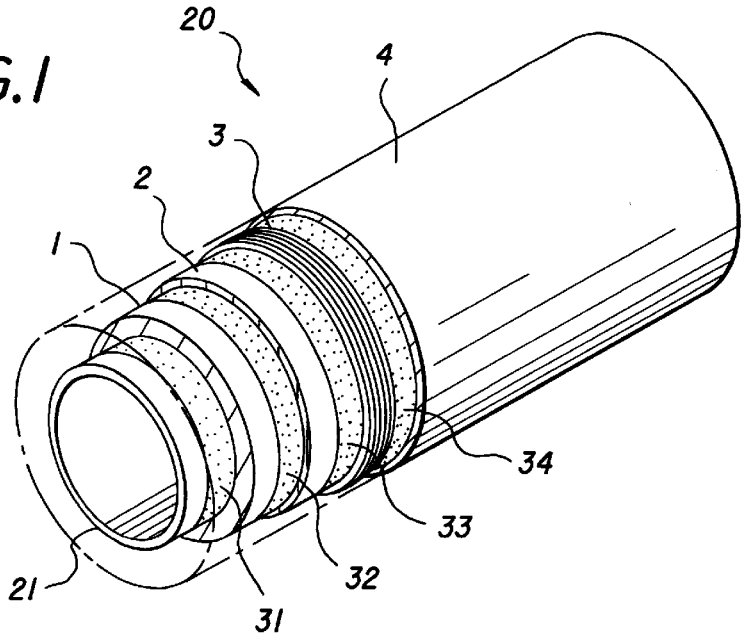
FIG. 1 is a partially cutaway view in perspective of an embodiment of a printing blanket in this invention.
Figure 2:
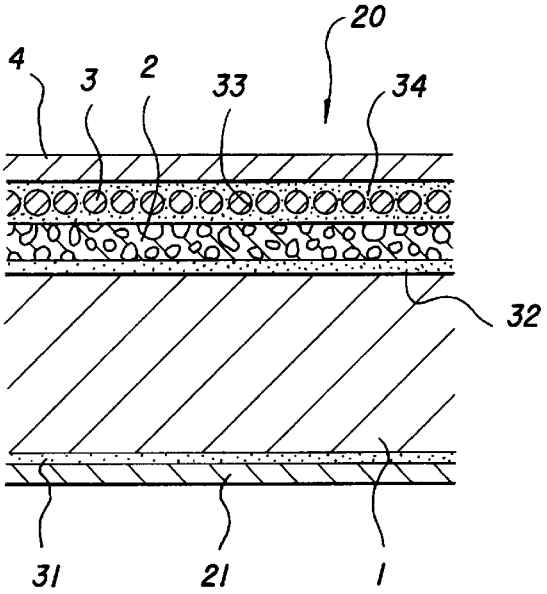
FIG. 2 is an enlarged section view showing the multi-layer structure of the printing blanket shown in FIG. 1.

As shown In FIGS. 1 and 2, the printing blanket 20 being one of the embodiments has the multi-layer structure in which on an outer the peripheral surface of the cylindrical sleeve 21, the base layer 1, the porous compressible layer 2, the non-stretchable layer 3 prepared by winding a non-stretchable wire rod around the compressible layer 2, and the surface printing layer 4 are laminated in this order, by interposing the adhesive layers 31 to 34 between the respective layers.

As the cylindrical sleeve 21, there can be used a variety of known sleeves including, for example, those made of pretty thin metallic material or fiber glass reinforced plastics, as previously described. In particular, from the view point of the rigidity, the strength and the elasticity, the sleeves made of nickel having a thickness of about 0.125 mm are suitable to the above printing blanket.

As the elastomer composing the base layer 1 which is formed on the peripheral surface of the sleeve 21 by interposing the adhesive layer 31, there can be used a variety of synthetic rubbers and thermoplastic elastomers. Preferred are elastomers which are particularly excellent in vibration absorbability and impact load absorbability, and have higher damping properties to vibration. It is more preferred that the above elastomers have high oil resistance in view of the resistance to printing inks and the like. Examples of these elastomers include synthetic rubbers such as acrylonitrile butadiene copolymer rubber (NBR), chloroprene rubber and urethane rubber.

The thickness of the base layer 1 is preferably 0.2 to 10.0 mm, particularly 0.4 to 5.0 mm, more particularly 0.8 to 2 0.

When the thickness of the base layer 1 is less than the above range, the base layer 1 cannot satisfactorily absorb vibration and impact load, and therefore, the printing image is unclear, resulting in poor printing quality. Further, in the respective layers composing the printing blanket 20, the dynamic fatigue and heat are generated due to high-speed repeated compression. As a result, the compressible layer 2 having lower strength than other layers might cause the permanent set in fatigue as described, shortening the life of the printing blanket 20. When the thickness of the base layer 1 is more than the above range, since the rate of change in peripheral length is increased when pressed by the plate cylinder, the printing image is unclear, resulting in poor printing quality.

When the base layer 1 is prepared from the synthetic rubber such as NBR, a sheet comprising an unvulcanized compound in which various additives are blended in an unvulcanized rubber, is adhered on the peripheral surface of the sleeve 21 on which the adhesive layer has been formed, and after being wrapped with tape or the like, is vulcanized under heating and pressurizing conditions. As a result, the seam of the sheet is fused to give a seamless base layer 1.

Examples of the above additives include filler, plasticizer, antioxidant, vulcanizing agent, accelerator, activator and retarder. Each amount may be similar to that of the conventional blankets. Specifically, to 100 parts by weight of unvulcanized rubber, the following amounts are preferable:

| | parts by weight |
|---|---|
| Filler such as carbon black: | 30 to 100 |
| Plasticizer such as stearic acid: | 0.5 to 1.5 |
| Antioxidant: | 1 to 4 |
| Vulcanizing agent such as sulfur: | 0.5 to 3 in total |
| Accelerator: | 0.5 to 3 |
| (each 0.5 to 3 when used two or more kinds) | |

-continued

| | parts by weight |
|---|---|
| Activator such as zinc oxide: | 3 to 5 |
| Retarder: | 0 to 0.5 |

In order to form the base layer 1 having a low thickness in the above range, the following manner, which is the same as in the compressible layer 2 and the surface printing layer 4 as described later, may be employed. Specifically, on the peripheral surface of the sleeve 21 on which the adhesive layer 31 has been formed, a rubber cement containing the respective additives is coated (spread) in a predetermined thickness with the use of a doctor blade or a doctor roll, which is then vulcanized under heating and pressuring conditions.

The surface of the base layer 1 thus prepared is preferably polished by a cylindrical grinding machine or the like to finish in a predetermined surface roughness and thickness.

The base layer 1 may be in a single-layer structure or a multi-layer structure.

A base layer similar to the base layer 1 can be provided between the non-stretchable layer 3 and the surface printing layer 4. With this structure, the function to absorb the vibration and the impact load and the function to prevent the ordinary.waves are further improved, thereby increasing the printing quality.

The compressible layer 2 which is formed on the base layer 1 by interposing the adhesive layer 1, has a porous structure excellent in vibration absorbability. The porous structure is classified into an open cell structure in which voids in a layer are connected with each other, and a closed cell structure in which voids are independent from each other. Both structures are applicable to this invention, but in order to effectively give the impact absorbability, the open cell structure is preferred.

The percent of void which indicates the proportion of voids for the compressible layer 2 having the open cell structure is not particularly limited, but preferably 30 to 60%, particularly 35 to 55%, more particularly 35 to 45%.

When the percent of void is below 30%, the compressible layer 2 could not satisfactorily absorb the impact. When it is over 60%, the strength of the compressible layer 2 might cause the permanent set in fatigue, shortening the life of the printing blanket 20.

As elastomer composing the compressible layer 2, those excellent in oil Resistance are suited. There are, for example, the same synthetic rubbers as described in the base layer 1.

the thickness of the compressible layer 2 is preferably 0.15 to 0.6 mm, particularly 0.2 to 0.5 mm, more particularly 0.2 to 0.3 mm. When it is below 0.15 mm, the compressible layer 2 could not satisfactorily absorb the pressure generated by the contact-press of the plate cylinder. Therefore, the surface of the printing blanket 20 is largely deformed by the press of the plate cylinder to cause a so-called bulge, which increases the rate of change in the peripheral length of the printing blanket 20. As a result, the printing image is unclear, resulting in poor printing quality.

When the thickness of the compressible layer is over 0.6 mm, the pressure of the printing blanket 20 to the plate cylinder and a paper is decreased. Therefore, the ink transfer ability to solid parts in the printing image (a so-called solid applicability) is reduced to cause ink squeezeout in the solid parts. Further, at the time of printing, the respective layers composing the printing blanket might slip toward downstream in the rotational direction of the printing blanket 20, resulting in shear of ink-transfer in the printing. In addition, the strength of the compressible layer 2 is decreased to cause the aforesaid permanent set in fatigue, thereby shortening the life of the printing blanket 20.

When the compressible layer 2 having the open cell structure is prepared from the aforesaid synthetic rubber, the following leaching method is suitable to produce the layer 2.

On the surface of the base layer 1 on which the adhesive layer 32 has been formed, a rubber cement in which the above additives and water soluble powder such as sodium chloride are blended in an unvulcanized rubber, is coated to (spread) to a predetermined thickness with the use of the doctor blade or the doctor roll, which is then vulcanized under heating and pressurizing conditions, thereby forming a vulcanized rubber layer.

The vulcanized rubber layer may be formed, like the base layer 1, by adhering a sheet comprising an unvulcanized compound containing the above additives, on the surface of the base layer 1 on which the adhesive layer 32 has been formed, followed by vulcanizing under heating and pressurizing in a state where the surface of the base layer 1 is wrapped with a tape or the like.

Then, the printing blanket 20 for which the vulcanized rubber, layer has been formed, is immersed in warm water of about 60° to 100° C. for about 6 to 10 hours to elute and remove the water soluble powder, and well dried to remove water, thereby giving a porous compressible layer 2 in which the traces of the water soluble power have turned into open cells.

As can be seen from the above description, the percent of void for the compressible layer 2 changes with the amount of the water soluble powder in the rubber cement or the unvulcanized compound. Specifically, as the amount of the water soluble powder compound is increased, the percent of void is increased. Therefore, the water soluble ponder should be blended at a specific amount adjusted to form a desired percent of void into the rubber cement or the unvulcanized compound.

On the other hand, for the formation of the compressible layer 2 having the closed cell structure, foaming method is preferably employed. Specifically, an expanding agent is added to the cement rubber or the unvulcanized compound, and the mixture is foamed at the time of vulcanization.

The surface of the compressible layer 2 thus prepared is preferably finished to have a predetermined surface roughness and thickness, with the use of a cylindrical grinding machine in the same manner as in the base layer 1.

The non-stretchable layer 3 which is formed on the compressible layer 2 by interposing the adhesive layer 33, is formed by winding a non-stretchable wire rod on the compressible layer 2 in circumferential direction in helical fashion while applying tension thereto.

Examples of the thread include cotton string, polyester string, and rayon, which are suitable, in view of the ease of the winding, the conformability with the adhesive layer 33 and 34, and the non-stretching property (i.e., tensile strength).

The diameter of the wire rod is not particularly limited, but preferably 0.1 to 0.5 mm, particularly 0.15 to 0.35 mm, more particularly 0.20 to 0.30 mm. When it is below 0.1 mm, the above winding work might be difficult. When it is over 0.5 mm, the wire rod might inhibit the compressible layer 2 from absorbing the pressure generated when the plate cylinder is pressed thereto, and the surface of the printing blanket 20 is liable to cause bulge, which increases the rate of change in the peripheral length. As a result, the printing image is unclear, resulting in poor printing quality.

In winding the wire rod in helical fashion, the spacing between the wire rods adjacent to each other is not particularly limited, but is preferably not more than 0.05 mm. It is more preferred to wind so as to have little spacing as shown in FIG. 1.

When the spacing is over 0.05 mm, the non-stretchable layer 3 might not satisfactorily prevent a large expansion in the radial direction and the resulting ordinary waves, which are caused by the elastic rebound of the printing blanket when it is released from the compression after passing the nip deformed portions.

The tensile strength in winding the wire rod (e.g., cotton string) in helical fashion is preferably 100 to 800 g, particularly 200 to 700 g, more particularly 300 to 500 g. When it is below 100 g, the aforesaid effect of the non-stretchable layer 3 is insufficient, thereby decreasing the compression of the printing blanket 20 with respect to the plate cylinder and a paper. As a result, the ink transfer ratio for solid parts in the printing image (the solid applicability) deteriorates, resulting in ink squeezeout. When it is over 800 g, the compressible layer 2 receives much load at the time of the winding of the wire rod to avoid the permanent set in fatigue.

For the elastomer composing the surface printing layer 4 which is formed on the compressible layer 3 by interposing the adhesive layer 3, there can be used those excellent in vibration absorbability and impact absorbability, damping properties to vibration, and oil resistance. There are, for example, the same synthetic rubbers as used in the base layer 1. In addition, polysulfide rubber and hydrogenated NBR are usable.

The thickness of the surface printing layer 4 is 0.1 to 0.4 mm, preferably 0.1 to 0.3 mm, more preferably 0.15 to 0.3 mm.

When it is below 0.1 mm, although the strength of the surface printing layer is increased, the compression of the printing blanket 20 to the plate cylinder and a paper is lowered. This might decrease the solid applicability, resulting in the squeezeout in solid parts.

When it is over 0.3 mm, at the time of printing, the surface printing layer 4 tends to slip downstream in the rotational direction of the printing blanket. As the slip is increased, the ratio of change in peripheral length is increased. This might produce unclear printing image, resulting in poor printing quality.

When the surface printing layer 4 is prepared from the above synthetic rubber, a rubber cement containing the aforesaid additives and unvulcanized rubber is coated (spread) in a predetermined thickness on the surface of the non-stretchable layer on which the adhesive layer 34 has been formed, with the use of the doctor blade or the doctor roll, followed by vulcanizing under heating and pressurizing conditions.

The surface printing layer 4 can also be formed, as in the base layer 1, by adhering a sheet comprising an unvulcanized compound containing the aforesaid additives on the surface of the non-stretchable layer 3 on which the adhesive layer 34 has been formed, followed by vulcanizing under heating and pressurizing conditions in the state that the surface of the sheet is wrapped with tape or the like.

The surface of the surface printing layer 4 is preferably finished to a predetermined surface roughness and thickness with the use of the cylindrical grinding machine or the like, in the same manner as in the base layer 1 and the compressible layer 2.

The surface roughness of the surface printing layer 4 correlates closely with the printing accuracy. Therefore, it is required to be strictly finished. The surface roughness is not particularly limited, but preferably ranges 1 to 10 $\mu$m, preferably 2 to 8 $\mu$m, more preferably 3 to 6 $\mu$m, according to ten points mean roughness (Rz).

As to the adhesive layer 31 between the sleeve 21 and he base layer 1, when the sleeve 21 is made of metal, suited are those comprising elastomer and having superior adhesive properties for both the metal and the elastomer used in the base layer 1. It is preferable to jointly use an adhesive having superior adhesion to metal and another having superior adhesion to the elastomer used in the base layer 1. Specifically, the former adhesive is coated using the doctor blade or the doctor roll on the surface of the sleeve, and the latter adhesive is coated thereon and dried in a similar manner to obtain an adhesive layer having the two-layer structure.

The former adhesive include "Chemlock 205" available from Load Chemical Corporation. When the base layer 1 is prepared from the NBR, "Chemlock 252X" available from Load Chemical Corporation, is used as the latter adhesive. These adhesives are unvulcanized rubbers, and act to bond between the sleeve 21 and the base layer 1 by vulcanizing them together with the base layer 1.

The thickness of the adhesive layer 31 is not particularly limited. It is preferable that the thickness of the adhesive layer having the two-layer structure be in a range of 0.02 to 0.25 mm. When it is below 0.02 mm, sufficient adhesive strength might not be obtained. When it is over 0.25 mm, the functions of other layers might be inhibited.

The adhesive layer 32 between the base layer 1 and the compressible layer 2; the adhesive layer 33 between the compressible layer 2 and the non-stretchable layer 3; and the adhesive layer 34 between the non-stretchable layer 3 and the surface printing layer 4, are prepared from elastomer, particularly synthetic rubbers excellent in oil resistance as previously described.

The adhesive layer 32 is prepared by coating a rubber cement containing the unvulcanized rubber of the aforesaid synthetic rubber on the surface of the base layer 1, with the use of the doctor blade or the doctor roll, and is subjected to the vulcanization together with the compressible layer 2 on the base layer 1.

The adhesive layer 33 is prepared by coating a similar rubber cement on the surface of the compressible layer 2 with the use of the doctor blade or the doctor roll, on which the wire rod composing the non-stretchable layer 3 is wound, followed by vulcanization, by which the adhesive layer 33 and the compressible layer 2 are molten and integrally formed around the wire rod as shown in FIG. 2.

The adhesive layer 34 is prepared by coating a rubber cement similar to those mentioned above on the surface of the non-stretchable layer 3 with the use of the doctor blade or the doctor roll, followed by the vulcanization together with the surface printing layer 4 which is formed on the non-stretchable layer 3.

Alternatively, after coating the rubber cement on the compressible layer 2, winding the wire rod, coating the rubber cement thereon, and forming the surface printing layer 4, all of the layers may be simultaneously vulcanized to form the adhesive layer 33, the non-stretchable layer 3, the adhesive layer 34 and the surface printing layer 4 at once.

The thicknesses of the adhesive layer 32, 33 or 34 is not particularly limited, and is preferably 0.01 to 0.1 mm. When it is below 0.01 mm, sufficient adhesive might not be obtained. When it is over 0.1 mm, the functions of other layers might be inhibited.

Thus, in accordance with this invention, it is possible to obtain high quality printing in a wide range from normal printing to high-speed printing, by the function of the seamless base layer, which comprises elastomer and is laminated on the peripheral surface of the cylindrical sleeve by Interposing the adhesive layer. It is also possible to obtain the printing blanket having no seam in the circumferential direction, which has high strength, prolonged life and the ease of handling to facilitate the reuse of the sleeve and the like.

EXAMPLES

The present invention will be further illustrated by the following nonlimiting examples.

Examples 1 to 7

Preparation of the Base Layer

A sleeve 21 made of nickel (the inner diameter: 169.5 mm; the length: 910 mm; the thickness: 0.125 mm, available from Taiyo Kogyo Co., Ltd.) was mounted on a mandrel for vulcanization which has a similar detachable sleeve mechanism under compressed gas, as in the aforesaid blanket cylinder. The outer peripheral surface of the sleeve 21 was coated and dried with the aforesaid "Chemlock 205", and then the aforesaid "Chemlock 252X" was coated thereon and dried, to prepare an adhesive layer 31 having the two layer structure (0.05 mm in thickness).

An unvulcanized compound comprising the following ingredients was kneaded using a kneader (available from Moriyama Seisakusho Co., Ltd.), and extruded using a 14×36 inch roll (available from KANSAI ROLL CO., LTD.) to prepare a sheet having the thickness of 2.0 mm and the width of 900 mm. This sheet was bonded on the surface of the adhesive layer 31.

Compound for the base layer

| (Ingredients) | (parts by weight) |
|---|---|
| Unvulcanized NBR | 100 |
| Furnace black (filler) | 60 |
| Silica filler | 40 |
| Stearic acid (plasticizer) | 1 |
| Aromatic oil (plasticizer) | 10 |
| Amine antioxide | 1.5 |
| Powder sulfur (vulcanizing agent) | 2.5 |
| Guanidine accelerator | 1 |
| Sulfenic amide accelerator | 0.5 |
| Zinc oxide (activator) | 5 |
| Phthalic anhydride (retarder) | 0.5 |

The surface of the sheet was wrapped with a nylon band having the width of 30 mm, with the use of a wrapping machine (available from Sumitomo Rubber Industries, Ltd.), and was vulcanized with a vulcanizer (1000×2000 mm, available from KANSAI ROLL CO., LTD.) at 140° C. and 3 kg/cm$^2$ for 90 minutes, and polished with a cylindrical grinding machine (available from Toyoda Koki Co., Ltd.), to give a base layer 1 having the thickness as shown in Table 1 (the dimensional tolerance: within ±0.01 mm).

Preparation of the Compressible Layer

On the surface of the above base layer 1, a rubber cement for adhesive layer which comprises the following ingredients was coated with a rotational spreader employing the doctor roll, and air-dried for 30 minutes to give an adhesive layer 32 (0.05 mm in thickness).

Rubber cement for the adhesive layer

| (Ingredients) | (parts by weight) |
|---|---|
| Unvulcanized NBR | 90 |
| Unvulcanized CR | 10 |
| Clay filler | 70 |
| Stearic acid (plasticizer) | 1 |
| Phenol antioxide | 1 |
| Powder sulfur (vulcanizing agent) | 1 |
| Guanidine accelerator | 1 |
| Sulfenic amide (accelerator) | 1 |
| Zinc oxide (activator) | 5 |
| Thermoset resin (adhesive) | 5 |
| Magnesium oxide | 3 |
| Toluene (solvent) | 100 |

On the surface of the above adhesive layer 32, a rubber cement for compressible layer which comprises the following ingredients, was coated with the aforesaid rotational spreading machine, and air-dried for 12 hours. The coated surface was tightly wound with a cotton-woven sheet (1000 mm in width), and then vulcanized with the aforesaid valcanizer at 140° C. and 3 kg/cm$^2$ for 90 minutes.

Rubber cement for the compressible layer

| (Ingredients) | (parts by weight) |
|---|---|
| Unvulcanized NBR | 100 |
| Furnace black (filler) | 30 |
| Clay filler | 40 |
| Stearic acid (plasticizer) | 1 |
| Phenol antioxide | 1 |
| Powder sulfur (vulcanizing agent) | 2.5 |
| Sulfenic amide (accelerator) | 1.5 |
| Thiuram accelerator | 1 |
| Zinc oxide (activator) | 5 |
| Sodium Chloride | 50 |
| Toluene (solvent) | 100 |

Then, the vulcanized matter was immersed in warm water of 70° C. for 12 hours to extrude and remove the sodium chloride, followed by hot-drying at 100° C. for 60 minutes, the surface of which is polished with the aforesaid cylindrical grinding machine to give a porous compressible layer 2 having the open cell (0.3 mm in thickness, within ±0.01 mm in dimensional tolerance, 35% in the percent or void).

Preparation of the Non-Stretchable Layer

On the surface of the above compressible layer 2, the same rubber cement as used in the adhesive layer 32 was coated by the aforesaid cylindrical spreading machine, and was air dried for 30 minutes to give an adhesive layer 33 (0.05 mm in thickness).

On the adhesive layer 33, a cotton string (0.250 mm in diameter) was wound in helical fashion while applying the tensile strength of 380±10 gf. The spacing between the cotton strings adjacent to each other was adjusted to not more than 0.05 mm. The winding of the cotton string was carried out by a cylinder-shaping machine (available from Sumitomo Rubber Industries, Ltd.)

The surface of the wound cotton string was wrapped up by tightly winding a cotton-woven sheet (1000 mm in width) in helical fashion in the circumferential direction, and was vulcanized using the aforesaid vulcanizer at 140° C. and 3 kg/cm$^2$ for 90 minutes, to prepare a non-stretchable layer 3.

Preparation of the Surface Printing Layer

On the above non-stretchable layer 3, the same rubber cement as used in the adhesive layer 32 was coated by the aforesaid rotational spreading machine, and air-dried to prepared an adhesive layer 34 having the thickness of 0.05 mm.

Then, on the above adhesive layer 34, a rubber cement comprising the following ingredients was coated by the aforesaid rotational spreading machine, and air-dried for 12 hours. The coated surface was wrapped up by tightly winding a cotton-woven sheet (1000 mm in width) in helical fashion in the circumferential direction, and then vulcanized with the aforesaid vulcanizer at 140° C. and 3 kg/cm$^2$ for 90 minutes.

Rubber Cement for the Surface Printing Layer

Rubber cement for the surface printing layer

| (Ingredients) | (parts by weight) |
|---|---|
| Unvulcanized NBR | 100 |
| Clay filler | 40 |
| Stearic acid (plasticizer) | 1 |
| Proceeeed oil (plasticizer) | 5 |
| Powder sulfur (vulcanizing agent) | 0.5 |
| Thiuram accelerator | 1 |
| Zinc oxide (activator) | 5 |
| Thermoset resin (adhesive) | 3 |
| Quinoline compound | 1 |
| Toluene (solvent) | 100 |

The surface of the vulcanized surface was polished with the aforesaid cylindrical grinding machine to prepare a surface printing layer 4 (0.2 mm in thickness, within ±0.01 mm in dimensional tolerance, 3 to 5 in ten points mean roughness (Rz)), thus obtaining a printing blanket.

Comparative Example 1

Using the same manner as in Examples 1 to 7, except that the base layer 1 and the adhesive layer 32 formed thereon were omitted, a printing blanket was obtained.

Comparative Example 2

On the surface of a fabric layer (the thickness: 1.05 mm, available from Moriuchi Orimono Co., Ltd.), (i) a porous compressible layer having the open cell structure (the thickness: 0.3 mm, the percent of void: 35%), which comprises the same rubber cement for the compressible layer as used in Examples 1 to 7; (ii) a reinforced layer (the thickness: 0.3 mm, available from Moriuchi Orimono Co., Ltd.); and (iii) a surface printing layer which comprises the same rubber cement for the surface printing layer as in Examples 1 to 7, are laminated in this order, to obtain a flat printing blanket.

Comparative Example 3

Out of the conventional printing blankets having no seam in the circumferential direction thereof, which are disclosed in Japanese Patent Unexamined Publication No. 5-301483 (1993), a printing blanket which is provided with a porous compressible layer having the open cell structure, was selected and prepared.

Specifically, on the peripheral surface of a sleeve made of nickel similar to that in Examples 1 to 7, the "Chemlock 205" and the "Chemlock 252X" were coated and dried in this order, to prepare an adhesive layer having the two-layer structure (0.05 mm in thickness). On the adhesive layer, a cotton string (0.375 mm in diameter) was coated with the same rubber cement for the compressible layer as in Examples 1 to 7, was wound in helical fashion and air-dried for 12 hours. The spacing between the strings was adjusted to not more than 0.025 mm.

After repeating the above coating and air-drying steps, the surface was wrapped up by tightly winding a cotton-woven sheet (1000 mm in width) in the circumferential direction, and then vulcanized at 140° C. and 3 kg/cm$^2$ for 90 minutes, which was immersed in warm water of 70° C. for 12 hours to extrude and remove sodium chloride, and heated and dried at 100° C. for 60 minutes, thus obtaining a compressible layer (1.5 mm in thickness, 35% in percent of void).

On the above compressible layer, a cotton string (0.175 mm in diameter) on which the same rubber cement as in Examples 1 to 7, was wound in helical fashion, and air-dried for 30 minutes, on which the same rubber cement was coated and air-dried for 12 hours.

Then, the surface of the coated rubber cement was wrapped up by tightly winding a cotton-woven sheet (1000 mm in width) in the circumferential direction, and then vulcanized using the aforesaid vulcanizer at 140° C. and 3 kg/cm$^2$ for 90 minutes.

Thereafter, the vulcanized surface was polished by the aforesaid cylindrical grinding machine to give a non-stretchable layer (0.25 mm in thickness), and a surface printing layer (0.45 mm in thickness, 3 to 5 in ten points mean roughness (Rz)), thus obtaining a printing blanket.

Comparative Example 4

Out of the conventional printing blankets having no seam in the peripheral direction, which are disclosed in the aforesaid publication, a printing blanket provided with a compressible layer in which plural micro spheres are dispersed, was selected and prepared as follows.

A printing blanket was obtained in the same manner as in Comparative Example 3, except that instead of the compressible layer, on the surface of an adhesive layer having the two-layer structure formed on the peripheral surface of the sleeve made of nickel, a rubber cement comprising the following ingredients was coated and air-dried for 12 hours, the coated surface was wrapped up by tightly winding a cotton-woven sheet (1000 mm in width) in the circumferential direction, and then vulcanized using the aforesaid vulcanizer at 140° C. and 3 kg/cm$^2$ for 90 minutes to prepare a compressible layer.

Rubber cement for the compressible layer

| (Ingredients) | (parts by weight) |
|---|---|
| Unvulcanized NBR | 100 |
| Furnace black | 30 |
| Clay filler | 40 |
| Stearic acid (plasticizer) | 1 |
| Phenol antioxidant | 1 |
| Powder sulfur (vulcanizing agent) | 2.5 |
| Sulfenic amide accelerator | 1.5 |
| Thiuram accelerator | 1 |
| Zinc oxide (activator) | 5 |
| Micro spheres* | 6 |
| Toluene (solvent) | 100 |

*Its product name: "Salanmicrosphere", available from Matsumoto Yushi Co., Ltd.

The following tests were conducted for each printing blanket prepared in Examples and Comparative Examples to evaluate its characteristics.

Evaluation of Vibration Absorbability

The viscoelasticity (tanδ) for each printing blanket was determined with a viscoelasticity spectrometer (product No. DVE-V4, available from Rheology Corp.). Based an the fact that as the tan δ is increased, the viscoelasticity is improved, the vibration absorbability for each printing blanket was evaluated.

To measure the tan δ, a 10 mm×10 mm sample penetrating the sleeve or the base layer was taken. To this sample, a 16 Hz sin-wave vibration having the amplitude of 0.05 mm and the initial strain of 0.1 mm was applied at ordinary temperature. The measuring conditions corresponded to that when the printing blanket is used for high-speed printing of 1000 r.p.m, the blanket receives about 17-time repeated compressions every second.

The tan δ for the compound composing the base layer 1 of each printing blanket after vulcanization was 0.05 when it was measured in accordance with the above measuring method.

Measurement of the Ratio of Change in Peripheral Length

Figure 3:
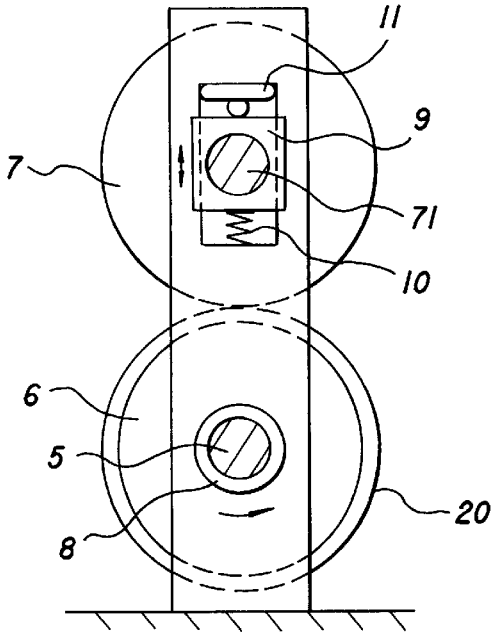
FIG. 3 is a side view showing a device for measuring the rate of change in the peripheral length of a printing blanket.

Using the device shown in FIG. 3, the ratio of change in peripheral length (%) for each printing blanket was determined. As described above, as the ratio of change in peripheral length is increased, the printing image is unclear and he printing quality deteriorates. Therefore, smaller values are preferred.

In the device of FIG. 3, the printing blanket 20 is mounted on the drum 6 which has the sleeve detachable mechanism with pressure gas, as in the aforesaid blanket cylinder, and is fixed to the drive shift 5 that is driven rotationally in the direction shown with an arrow in FIG. 3. With the drum 7 corresponding to the plate cylinder for offset rotational printings pressed against the printing blanket 20 from above with a predetermined depression, the drive shift was rotated a number of times to obtain the difference in the rotations of drums 6 and 7, from which the ratio of change in peripheral length (%) was determined.

In FIG. 3, the reference numeral 8 denotes a bearing unit that supports the drive shift 5; 9 denotes a bearing unit that supports the shaft 71 of the drum 7 and is movable upward and downward as shown with the white arrow; 10 denotes a spring that supports the bearing unit 9 from below; and 11 denotes a load cell for measuring the compression of the drum 7 with respect to the printing blanket 20.

In the above device, by replacing the drum 7 with one having different diameter, the depression of the drum 7 to the printing blanket can be adjusted.

In measuring the change in peripheral length for the flat printing blanket in Comparative Example 2, the drum 6 is replaced with the same drum as in the conventional blanket cylinder around which a blanket is wound.

The measuring conditions to determine the ratio of change in peripheral length with the use of the above device were as follows:

| | |
|---|---|
| Diameter of the drum 6 (for seamless printing blanket) | 169.520 mm |
| Diameter of the drum 6 (for flat printing blanket) | 170.100 mm |
| Diameter of the drum 7 | 173.915 mm |
| Depression of the drum 7 to the printing blanket 20 | 0.1 mm |
| Rotational speed of the drive shaft 5 | 1,000 r.p.m |
| Revolution of the drive shaft 5 | 500 times |

In the measuring, it was confirmed as to whether every 100 times of revolution, the difference in revolution between the drum 7 and the drum 6 was plus (the drum 7 had more revolutions than the drum 6), or minus (the drum had less revolutions than the drum 6). As a result, all the differences in the revolutions were plus.

Measurement of the Permanent Set in Fatigue

Using the aforesaid device used in the measurement of the ratio of change in peripheral length, the amount of the permanent set in fatigue (mm) for each printing blanket was determined. Based on the obtained results, the durability for each printing blanket was evaluated. As the amount is decreased, the durability is increased.

Specifically, under the conditions that the depression of the drum 7 to the printing blanket 20 was 0.1 mm and the rotational speed of the drive shaft 5 was 1000 r.p.m, each printing blanket was continuously rotated for 100 hours, and the reduction of the thickness (mm) of the printing blanket was determined as the amount of the permanent set in fatigue Table 1 shows the results:

TABLE 1

| | Thickness (mm) | | Entire | Ratio of change in peripheral | Permanent set in |
|---|---|---|---|---|---|
| | Entire | Base layer | tan δ | length (%) | fatigue (mm) |
| Comp. Ex. 1 | 0.8 | — | 0.165 | 0.14 | 0.11 |
| Ex. 1 | 1.0 | 0.2 | 0.218 | 0.08 | 0.07 |
| Ex. 2 | 1.6 | 0.8 | 0.228 | 0.07 | 0.06 |
| Ex. 3 | 2.2 | 1.4 | 0.251 | 0.06 | 0.05 |
| Ex. 4 | 2.8 | 2.0 | 0.256 | 0.06 | 0.04 |
| Ex. 5 | 5.8 | 5.0 | 0.262 | 0.08 | 0.05 |
| Ex. 6 | 10.8 | 10.0 | 0.273 | 0.10 | 0.05 |
| Ex. 7 | 12.8 | 12.0 | 0.273 | 0.12 | 0.05 |
| Comp. Ex. 2 | — | — | 0.257 | 0.05 | 0.05 |
| Comp. Ex. 3 | — | — | 0.180 | 0.15 | 0.10 |
| Comp. Ex. 4 | — | — | 0.172 | 0.15 | 0.09 |

From the results in Table 1, it was confirmed that when the thickness of the base layer was in a range of 0.2 to 10.0 mm, there could be obtained good results in the vibration absorbability, the ratio of change in the peripheral length and the durability.

Examples 8 to 14

Using the same manner as in Example 3, except that the thickness of the surface printing layer 4 was set to that in Table 2, a printing blanket 20 was prepared.

For the printing blankets prepared in above Examples, Example 3 and Comparative Examples 2 to 4, the above measurement of the ratio of change in peripheral length and the following solid applicability evaluation were conducted to evaluate each characteristics.

Evaluation of Solid Applicability

Each printing blanket was mounted on a high speed offset rotational printing, and using oil based ink of Japanese-ink color, the solid printing was carried out on the surface of a woodfree paper.

The standard deviation in brilliance for the solid part of the above printing was determined with an image processing device (Model No. LA555, available from Piasu Co., Ltd.). Based on the fact that as the standard deviation of brilliance is decreased, the solid applicability is increased, the solid applicability for each printing blanket was evaluated. Table 2 shows the results.

TABLE 2

| | Thickness (mm) | | | |
|---|---|---|---|---|
| | Entire | Surface printing layer | Ratio of change in peripheral length (%) | Standard deviation in brilliance |
| Ex. 8 | 2.1 | 0.1 | 0.05 | 19.7 |
| Ex. 9 | 2.15 | 0.15 | 0.05 | 18.2 |
| Ex. 3 | 2.2 | 0.2 | 0.06 | 17.3 |

TABLE 2-continued

| | Thickness (mm) | | | |
|---|---|---|---|---|
| | Entire | Surface printing layer | Ratio of change in peripheral length (%) | Standard deviation in brilliance |
| Ex. 10 | 2.25 | 0.25 | 0.06 | 17.2 |
| Ex. 11 | 2.3 | 0.3 | 0.06 | 16.9 |
| Ex. 12 | 2.4 | 0.4 | 0.07 | 17.4 |
| Ex. 13 | 2.5 | 0.5 | 0.12 | 17.1 |
| Ex. 14 | 2.6 | 0.6 | 0.14 | 17.3 |
| Comp. Ex. 2 | 1.95 | 0.2 | 0.05 | 18.9 |
| Comp. Ex. 3 | 2.2 | 0.45 | 0.15 | 23.4 |
| Comp. Ex. 4 | 2.2 | 0.45 | 0.15 | 21.5 |

From the results in Table 2, it was confirmed that when the thickness of the surface printing layer was in a range of 0.1 to 0.4 mm, there could be obtained good results in the ratio of change in circumference and the solid applicability.

Examples 15 to 21

Using the same manner as in Example 3, except that the thickness of the compressible layer 3 was set to that in Table 3, a printing blanket 20 was prepared.

For the printing blankets of Examples 15–21, Example 3 and Comparative Examples 2 to 4, the measurement of the ratio of change in circumference, the evaluation of the solid applicability and the measurement of the permanent set in fatigue were conducted to evaluate each characteristics. Table 3 shows the results.

TABLE 3

| | Thickness (mm) | | | | |
|---|---|---|---|---|---|
| | Entire | Compressible layer | Rate of change in peripheral length (%) | Standard deviation in brilliance | Permanent set in fatigue (mm) |
| Ex. 15 | 2.0 | 0.1 | 0.11 | 16.9 | 0.02 |
| Ex. 16 | 2.05 | 0.15 | 0.08 | 17.2 | 0.03 |
| Ex. 17 | 2.1 | 0.2 | 0.05 | 17.2 | 0.04 |
| Ex. 3 | 2.2 | 0.3 | 0.06 | 17.3 | 0.05 |
| Ex. 18 | 2.3 | 0.4 | 0.05 | 18.4 | 0.05 |
| Ex. 19 | 2.4 | 0.5 | 0.05 | 19.2 | 0.06 |
| Ex. 20 | 2.5 | 0.6 | 0.06 | 19.7 | 0.06 |
| Ex. 21 | 2.6 | 0.7 | 6.08 | 22.0 | 0.09 |
| Comp. Ex. 2 | 1.95 | 0.3 | 0.05 | 18.9 | 0.05 |
| Comp. Ex. 3 | 2.2 | 1.5 | 0.15 | 23.4 | 0.10 |
| Comp. Ex. 4 | 2.2 | 1.5 | 0.15 | 21.5 | 0.09 |

From the results in Table 3, it was confirmed that when the thickness of the compressible layer was in a range of 0.15 to 0.6 mm, there could be obtained good results in the ratio of change in peripheral length, the solid applicability and the durability.

Examples 22 to 25

The procedures as in Example 3 were carried out except that the amount of sodium chloride in the rubber cement for the compressible layer comprising the compressible layer 2 was adjusted as follows:

| | Amount of sodium chloride |
|---|---|
| (Example No.) | (Parts by weight) |
| 22 | 85 |
| 23 | 140 |
| 24 | 160 |
| 25 | 170 |

Examples 26 to 30

Using the sane manner as in Example 3, except that the compressible layer 2 prepared by foaming in order to have closed cell structure was used, a printing blanket 20 was prepared.

Specifically, a rubber cement for the compressible layer in which instead of the sodium chloride, an expanding agent of dinitrosopentamethylenetetramine (DPT) and an expanding promoting agent of urea compound were blended in the following amounts, was coated by the aforesaid rotational spreading machine, and dried for 12 hours. The coated surface was trapped up by tightly winding a cotton sheet (1000 mm in width) in the circumferential direction, and then vulcanized while foaming, at 140° C. and 3 kg/cm$^2$ for 90 minutes, to prepare a compressible layer 2 having the closed cell structure.

| | Amounts (parts by weight) | |
|---|---|---|
| Example No. | Expanding agent | Expanding promoting agent |
| 26 | 5 | 5 |
| 27 | 6 | 6 |
| 28 | 8.5 | 8.5 |
| 29 | 9.5 | 9.5 |
| 30 | 10 | 10 |

For the printing blankets prepared in the above Examples, Examples 3 and Comparative Examples 2 to 4, the aforesaid measurement of the vibration absorbability was conducted to evaluate each characteristic. Table 4 shows the results.

TABLE 4

| | Compressible layer | | |
|---|---|---|---|
| | Porous structure | Percent of void (%) | Entire tan δ |
| Ex. 22 | Open cell | 30 | 0.236 |
| Ex. 3 | Open cell | 35 | 0.251 |
| Ex. 23 | Open cell | 50 | 0.258 |
| Ex. 24 | Open cell | 55 | 0.264 |
| Ex. 25 | Open cell | 60 | 0.266 |
| Ex. 26 | Closed cell | 30 | 0.198 |
| Ex. 27 | Closed cell | 35 | 0.235 |
| Ex. 28 | Closed cell | 50 | 0.244 |
| Ex. 29 | Closed cell | 55 | 0.248 |
| Ex. 30 | Closed cell | 60 | 0.250 |
| Comp. Ex. 2 | Open cell | 35 | 0.257 |
| Comp. Ex. 3 | Open cell | 35 | 0.180 |
| Comp. Ex. 4 | minimum spheres | 35*1 | 0.172 |

*1: volume ratio of the minimum spheres

From the results in Table 4, it was confirmed that the open cell structure was superior to the closed cell structure in view of the vibration absorbability.

Example 31

After forming the base layer 1, the compressible layer 2 and the non-stretchable layer 3 in the same manner as in Example 3, the same rubber cement for the adhesive layer as in Example 3 was coated on the surface of the non-stretchable layer 3 with the aforesaid rotational spreading machine, and air-dried for 30 minutes to prepare an adhesive layer (0.05 mm in thickness).

On the surface of this adhesive layer, a rubber cement in which the same compound for the base layer as used in Example 3 was dissolved in 100 parts by weight of toluene, was coated in the same manner as described and air-dried for 12 hours. The coated surface was wrapped up by tightly winding a cotton sheet (1000 mm in width) in the circumferential direction, and was vulcanized using the aforesaid vulcanizer at 140° C. and 3 kg/cm$^2$ for 90 minutes, and further, the vulcanized surface was polished by the aforesaid cylindrical grinding machine to prepare a second base layer (0.2 mm in thickness).

On the surface of the second base layer, the adhesive layer 34 and the surface printing layer 4 were formed in the same manner as in Example 3, to prepare a printing blanket.

For this printing blanket, the respective tests as described were conducted to evaluate its characteristics. Table 5 shows the results together with those of Example 3.

TABLE 5

| | Entire tan δ | Ratio of change in peripheral length (%) | Standard deviation in brilliance | Permanent set in fatigue (mm) |
|---|---|---|---|---|
| Ex. 31 | 0.28 | 0.04 | 17.2 | 0.04 |
| Ex. 3 | 0.251 | 0.06 | 17.3 | 0.05 |

From the results in Table 5, it was confirmed that when the second base layer was formed between the compressible layer 3 and surface printing layer 4, there could be obtained improved results in the vibration absorbability, the ratio of change in peripheral length and the durability.

What is claimed is:

1. A printing blanket comprising:

(a) a seamless base layer comprising an elastomer and being substantially incompressible;

(b) a porous seamless compressible layer comprising an elastomer;

(c) a non-stretchable layer comprising a non-stretchable thread which is wound on the compressible layer in helical fashion along the circumferential direction; and (d) a seamless surface printing layer comprising an elastomer, all of which are provided in this order on an outer peripheral surface of a cylindrical sleeve mounted on a blanket cylinder.

2. A printing blanket according to claim 1, wherein seamless adhesive layers each comprising elastomer are interposed between said base layer and said compressible layer, between said compressible layer and said non-stretchable layer, and between said non-stretchable layer and said printing layer.

3. A printing blanket according to claim 1, wherein the base layer has a thickness of 0.2 to 10.0 mm, the compressible layer has a thickness of 0.15 to 0.6 mm and the surface printing layer has a thickness of 0.1 to 0.4 mm.

4. A printing blanket according to claim 1, wherein the compressible layer is of open cell structure having a percent of void ranging 30 to 60%.

5. A printing blanket according to claim 1, further comprising a seamless intermediate layer and an adhesive layer provided between the non-stretchable layer and the surface printing layer, said intermediate layer comprising an elastomer.

* * * * *

UNITED STATES PATENT AND TRADEMARK OFFICE

CERTIFICATE OF CORRECTION

PATENT NO. : 5,832,824

DATED : November 10, 1998

INVENTOR(S) : Okubo et al.

It is certified that error appears in the above-identified patent and that said Letters Patent is hereby corrected as shown below:

On the title page, after item [22] insert the following;
—[30] Foreign Application Priority Data
Feb. 16, 1995...[JP]...Japan..... 7-28312--.

Signed and Sealed this

Ninth Day of March, 1999

*Attest:*

*Attesting Officer*

Q. TODD DICKINSON

*Acting Commissioner of Patents and Trademarks*